US005133251A

United States Patent [19]

Johnson et al.

[11] Patent Number: 5,133,251

[45] Date of Patent: Jul. 28, 1992

[54] BALER WITH END PAD INSERTION

[75] Inventors: Jerold W. Johnson, Bellevue; John B. Russell, Milan; Ronald P. Hartman; Daniel J. Schaeffer, both of Bellevue, all of Ohio

[73] Assignee: The American Baler Company, Bellevue, Ohio

[21] Appl. No.: 493,513

[22] Filed: Mar. 14, 1990

[51] Int. Cl.[5] ..... B65B 13/06; B30B 1/00

[52] U.S. Cl. ..... 100/19 R; 53/529; 100/44; 100/180; 100/183

[58] Field of Search ..... 100/44, 180–184, 100/17, 18, 19 R, 31; 53/529

[56] References Cited

U.S. PATENT DOCUMENTS

| | | | |
|---|---|---|---|
| 1,412,021 | 4/1922 | Welger | 100/183 X |
| 1,932,917 | 10/1933 | Taylor | 100/183 X |
| 2,682,137 | 6/1954 | Cox | 53/529 |
| 2,775,930 | 1/1957 | Anderson et al. | 100/180 |
| 3,024,719 | 3/1962 | Englund | 100/183 X |
| 3,420,161 | 1/1969 | Freund | 100/184 X |
| 4,092,913 | 6/1978 | Tea | 100/31 X |
| 4,991,498 | 2/1991 | McCurdy | 100/19 R X |

FOREIGN PATENT DOCUMENTS

| | | | |
|---|---|---|---|
| 349048 | 2/1922 | Fed. Rep. of Germany | 100/19 R |

*Primary Examiner*—Philip R. Coe
*Assistant Examiner*—Stephen F. Gerrity
*Attorney, Agent, or Firm*—Pearne, Gordon, McCoy & Granger

[57] ABSTRACT

A continuous extrusion type reciprocating baling apparatus includes an end pad insertion mechanism which permits end pads to be automatically inserted into the baling chamber at each end of the bale. The end pad insertion mechanism works in conjunction with a bale tying apparatus so that end pads can be provided on each end of automatically tied bales. The end pad insertion mechanism is located above the baling chamber so that end pads are inserted downwardly into the baling chamber, to permit the typing apparatus to be provided on each side of the baler. The end pad insertion mechanism includes an enclosure for containing a supply of end pads and a plate to push the end pads downwardly through a slot provided in the baling chamber.

13 Claims, 4 Drawing Sheets

BALER WITH END PAD INSERTION

BACKGROUND OF THE INVENTION

1. Field of the Invention

This invention relates to apparatus for automatically compressing material into bales in a continuous extrusion type baling machine, and more particularly to apparatus for baling material which require end pads in the finished bale.

2. Description of the Prior Art

Continuous extrusion type baling machines have been well known in the baling art and have conventionally comprised a horizontal baling chamber having a floor, having sides for constraining the bale laterally and having an open forward end of controllable cross section from which the bales were extruded, and a feed hopper opening in the top side of the baling chamber for delivering the material to be baled. A baling head reciprocated in the baling chamber past the feed hopper opening between a rearward position of retraction and a forward position of extension. The baling head was conventionally driven by a hydraulic ram.

In operation, a charge of compressible material was dumped into the hopper and dropped into the baling chamber when the baling head was retracted. Successive charges were compressed and compacted together in the baling chamber by repeated strokes of the baling head against the resistance of material that had been previously compressed and extruded through the throat. In this manner a length of compacted and compressed material was formed and extruded through and out the open end of the baling chamber. When a bale, i.e., a length of compressed material suitable and convenient for handling, had been accumulated in the baling chamber, the bale was bound and tied with a suitable number of wires, preferably while held in a compressed state between the baling head and the immediately preceding last bale that was tied.

Bale ties have been placed and twisted together or otherwise secured by hand operations. For example, U.S. Pat. No. 3,024,719, disclosed, among other things, a horizontal, continuous baler equipped to place blocks between the otherwise abutting ends of successively formed bales. The blocks were provided with groves on opposite faces that extended laterally across the ends of the bales. A tie wire could be passed through the grooves and along the sides and thus around the bale being tied. Conventionally, the ends of a tie were twisted together.

Such a method of and apparatus for tying bales was slow and expensive because of the labor required and the blocks used. To replace this manual process, the automatic tying apparatus of U.S. Pat. No. 4,092,913 was developed. This automatic tying apparatus could operate unattended and without blocks and could conveniently and economically be used as an accessory to a conventional horizontal continuous baler. The apparatus comprised tie wire dispensing and guide means on opposite sides of the baler, and wire pullers, twisters and cutters all on the same side of the baler. The wire pullers extended from the one side of the baler to the other or second side of the baler and engaged wires on the second side and pulled them to the first side together with the wire extending along the second side. The pullers positioned both wires adjacent the twisters and the cutter. The twister produced twisted joints in the tie wires. This apparatus provided a suitable means for automatically tying bales produced by an extrusion-type baler, but it was not readily adaptable for use in baling all types of substances.

In baling certain substances, such as mineral wool, it has been necessary to provide corrugated pads at each end of the bale to provide the bale with the necessary stability so that the tying wires could hold the compressed material in the bale. In the past, such end pads have usually been placed on the ends of the bale by hand as part of a manual tying process. It has not been possible heretofore to form bales using an automatic tying apparatus with end pads in the bales since there has been no way to insert the end pads into the baler before the bales were tied.

While it may have been possible to insert end pads at the beginning and end of each bale in the same manner that the tying blocks were inserted as disclosed in U.S. Pat. No. 3,024,719, there is no indication that such a process has ever been attempted. Furthermore, event if such a procedure were used, it would still require hand tying since the block insertion means of U.S. Pat. No. 3,024,719 were intended for hand tying and were basically incompatible the automatic tying apparatus of U.S. Pat. No. 4,092,913.

SUMMARY OF THE INVENTION

The present invention by its unique structure and arrangement of elements and functions, overcomes the disadvantages of the prior art described above and produces a mechanically and economically desirable and improved apparatus for automatically forming bales of materials with end pads in an extrusion-type baling machine. Briefly, the apparatus embodying the present invention is for use with a baler including a baling chamber having sides, a feed hopper having an opening into the chamber for delivering material to be baled, a baling head reciprocable with the chamber past the feed hopper opening to a forward position of extension and means such as a hydraulic ram for reciprocating the head. The apparatus embodying the present invention comprises an end pad insertion mechanism located above the baling chamber which inserts end pads into the stream of compressed material at the beginning and end of each bale and before the baling tying procedure, so that pads can be automatically and routinely provided at the ends of the bale as necessary for the stability of the tied bale.

The present invention provides an end pad insertion mechanism which inserts end pads into the baling chamber vertically from the top instead of inserting the end pads vertically from the side. By inserting the end pads downwardly, interference with the automatic bale tying mechanism is avoided since the bale tying mechanism ordinarily inserts tying wires horizontally from the sides of the baling chamber. The downward insertion of the end pads also allows for gravity to assist in dropping the end pads into the baling chamber.

The end pads are inserted by a pushing plate which moves vertically to push individual end pads downwardly through a slot provided in the upper side of the baling chamber. The plate is actuated by a lever arm and a fluid cylinder to provide a simple reliable mechanism to insert the end pads into the baling chamber. The lever arm arrangement allows the fluid cylinder to be mounted below the maximum height of the retracted plate, so that the overall height of the baling machine is minimized.

The end pad insertion mechanism of the present invention includes an enclosure in which a supply of end pads is maintained. The end pads are stored in the enclosure in a vertical position so that they can be pushed into the baling chamber without unnecessary manipulation and reorientation. A pusher head is also provided to move the end pads into position adjacent to the slot so that they can be easily pushed into the baling chamber.

The baling machine of the present invention can then be sequenced to insert end pads into the baling chamber at the beginning and end of each bale forming operation and can be used in conjunction with an automatic tying apparatus to insert an end pad into the baling chamber before the bale is compressed against the last finished bale in the throat portion or extrusion end of the baling machine, and to insert a second end pad into the baling chamber immediately before the tying mechanism inserts the tie wires and ties the finished bale.

These and other advantages are provided by the present invention of a baling apparatus which comprises a longitudinally horizontally extending frame. The frame includes a horizontal floor, a horizontal upper side extending generally parallel to the floor and thereabove, and fixed vertical enclosing sides extending perpendicularly from the floor to the upper side to form a baling chamber therewithin. The upper side has a feed opening in the upper side at the baling chamber through which material to be baled is delivered into the baling chamber. The upper side also has a slot. The baling apparatus also comprises a baling head longitudinally reciprocal within the baling chamber between a retracted position and an advanced position, means for reciprocating the baling head, and means for inserting an end pad downwardly through the slot into the baling chamber.

DETAILED DESCRIPTION OF THE PREFERRED EMBODIMENT

Figure 1:
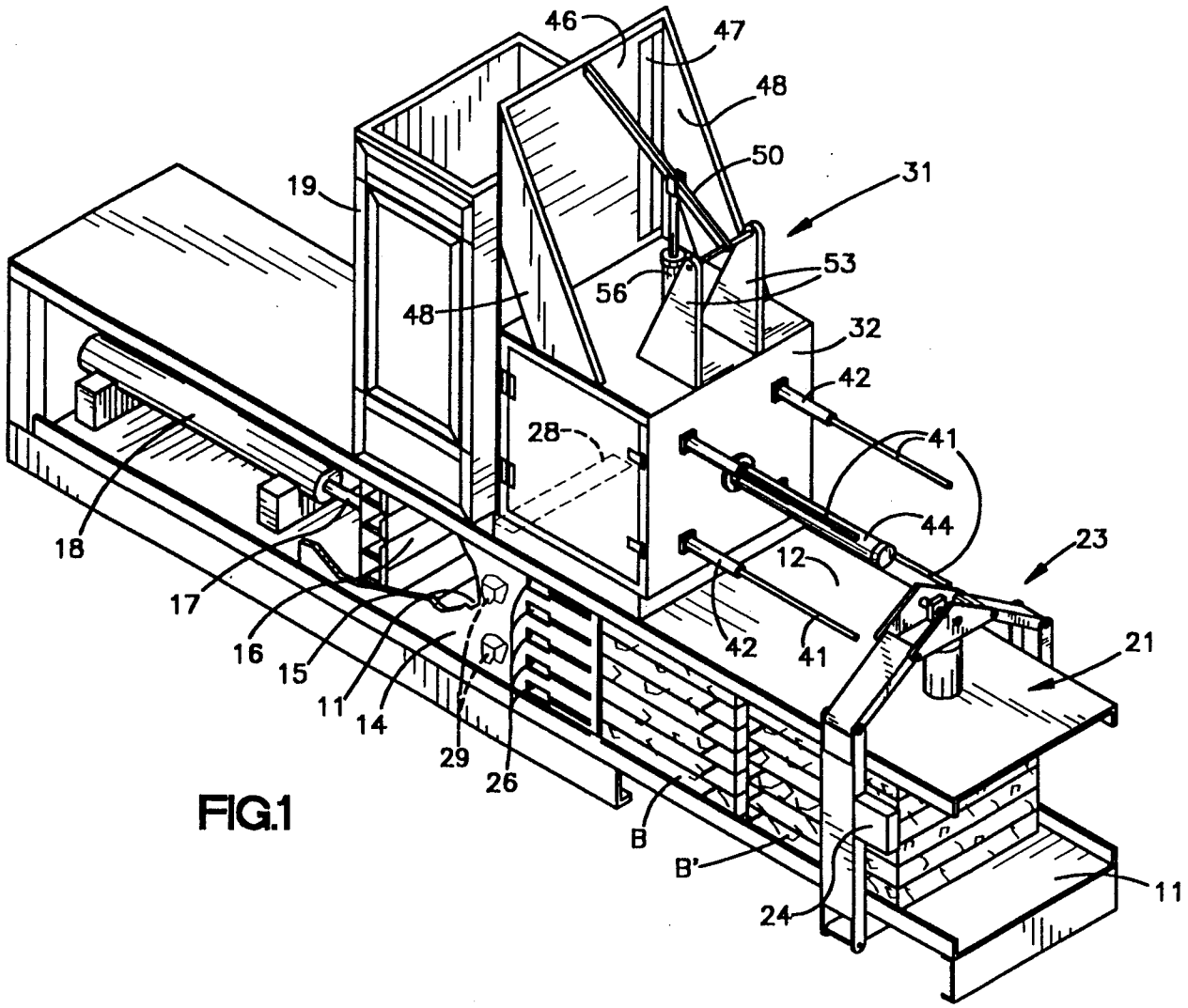
FIG. 1 is a perspective view of a baling machine which includes the apparatus of the present invention with portions of the baling machine removed for clarity.

Referring more particularly to the drawings and initially to FIG. 1, there is shown a baling machine 10 which includes the apparatus of the present invention. The baling machine 10 has a support frame which includes a longitudinally extending floor 11. Extending parallel to and spaced above the floor 11 is an upper side 12.

Along a portion of the baling machine 10, the floor 11 and the upper side 12 are connected by enclosing sides 14 to form a baling chamber 15. Within the baling chamber 15 is a baling head 16 reciprocated by a ram means comprising a piston rod 17 extending from a hydraulic cylinder 18. At the rearward end of the baling chamber 15, a feed opening is formed in the upper side 12 to permit the baling chamber to communicate with a feed hopper 19. Although a conventional open feed hopper 19 is shown, it is understood that other types of hoppers can be used. For example, when baling mineral wool, it is preferable to use a weigh hopper. Suitable weigh hoppers are well known in the art and need not be described here.

Figure 2:
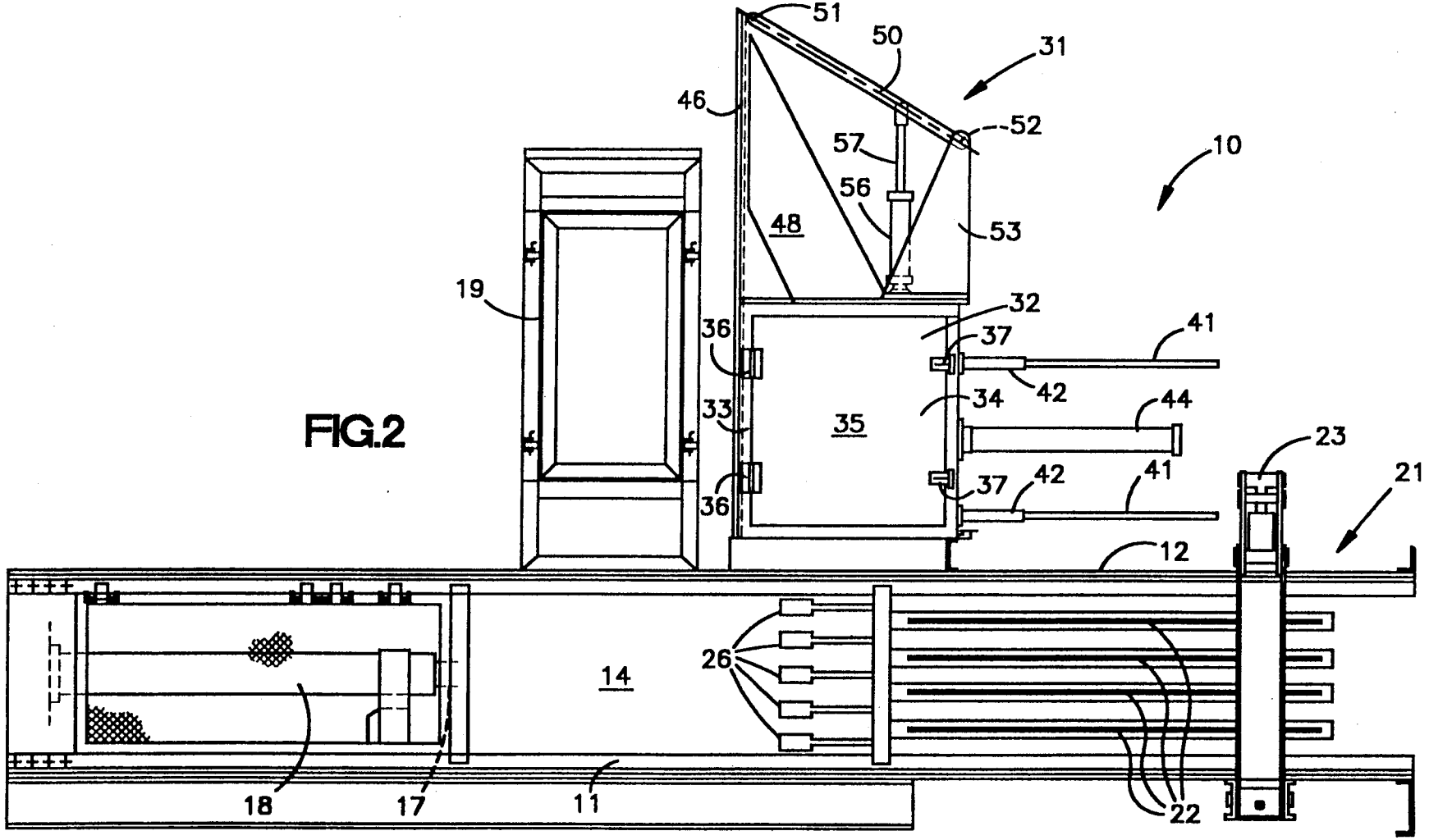
FIG. 2 is a side elevational view of the baling machine of FIG. 1.

Downstream of the baling chamber 15 is a throat portion 21 having movable side segments 22. (The side segments 22 are shown in FIG. 2 but are removed for clarity in FIG. 1.) A conventional toggle-like mechanism 23 in the throat portion 21 provides resistance to the movement of the bales by constricting the space between the floor 11 and the upper side 12. A bale length measuring device 24 may provided to measure the amount of material passing through the throat portion 21 by measuring the movement of the finished bales B. Alternatively, a counter may be used in association with a weigh hopper to measure the weight of the material that is compressed.

The bales of compressed material formed in the baling chamber 15 may tied automatically using the apparatus shown in U.S. Pat. No. 4,092,913, the disclosure of which is herein incorporated by reference. Since a suitable tying apparatus is fully described in that patent, it is not shown herein, but its application to the baling apparatus of the present invention is easily understood. A plurality of openings 26 are provided in the side 14 of the baling chamber 15 through which tying wires may be inserted. The side openings 26 correspond in number and location to the tying wires to be placed around each bale. It is understood that the automatic bale tying apparatus of U.S. Pat. No. 4,092,913 would be placed on either side of the baling machine 10 at the location of the openings 26.

When baling certain material, such as mineral wool, it is necessary to provide corrugated pads at each end of the bale to provide the bale with the necessary stability so that the wire can hold the compressed material in the bale. The end pads typically are approximately 29 inches (74 cm) wide and 38½ inches (98 cm) high.

The end pads are inserted into the baling chamber 15 through a slot 28 provided in the upper side 12 at the downstream end of the baling chamber. The slot 28 is sufficiently large to allow a single end pad to pass therethrough but is preferably small enough to prevent more than one end pad to pass through. A plurality of retainer dogs 29 are provided on the inside of the enclosing sides 14 of the baling chamber 15 to hold the end pad that is inserted through the slot 28 in a vertical position and prevent the end pad from falling over.

Figure 3:
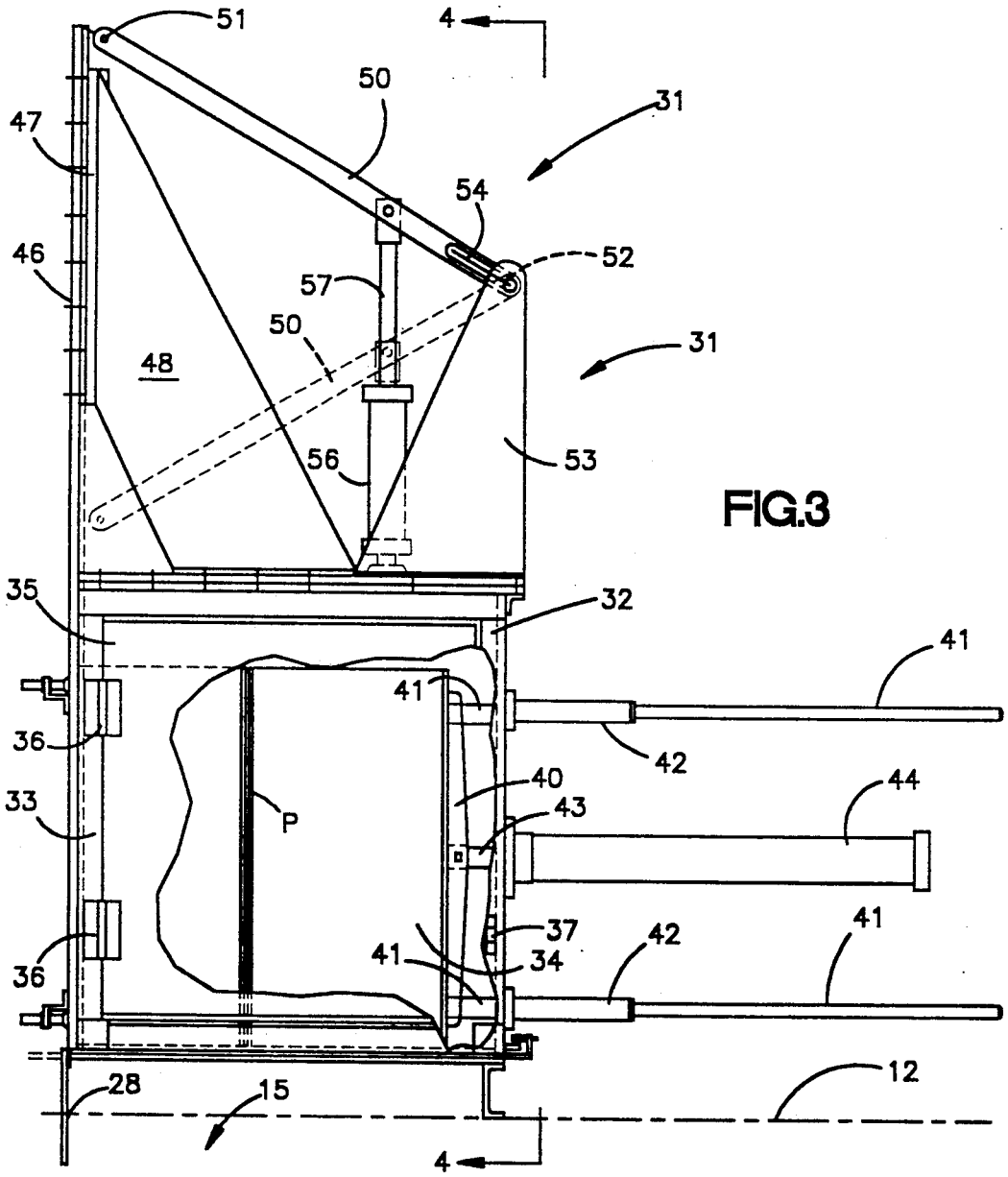
FIG. 3 is a detailed side elevational view showing a portion of the baling machine of FIG. 2 to a larger scale with portions removed.

The end pads are pushed downwardly through the slot 28 by an end pad insertion mechanism 31 which includes an enclosure 32 containing a supply of end pads P, as shown in FIG. 3. The interior dimensions of the enclosure 32 conform to the exterior dimensions of the end pads, allowing the end pads to fit snugly with the enclosure but permitting the end pads to be moved horizontally within the enclosure. The enclosure 32 is mounted on top of the baler at the downstream end of the baling chamber 15. The enclosure 32 has an ejection end 33 located directly above the slot 28 and a supply end 34 opposite the ejection end 33. End pads P are stacked vertically in the enclosure 32 between the ejection end 33 and the supply end 34 as shown in FIG. 3. An access door 35 (FIG. 2) is provided on one side of the enclosure 32 for filling the enclosure 32 with end pads. The access door 35 is mounted by hinges 36 and retained in a closed position by latches 37. End pads may be provided in cartridges which are then placed in the enclosure 32 through the access door 35. A typical cartridge would contain approximately 85 end pads.

Figure 4:
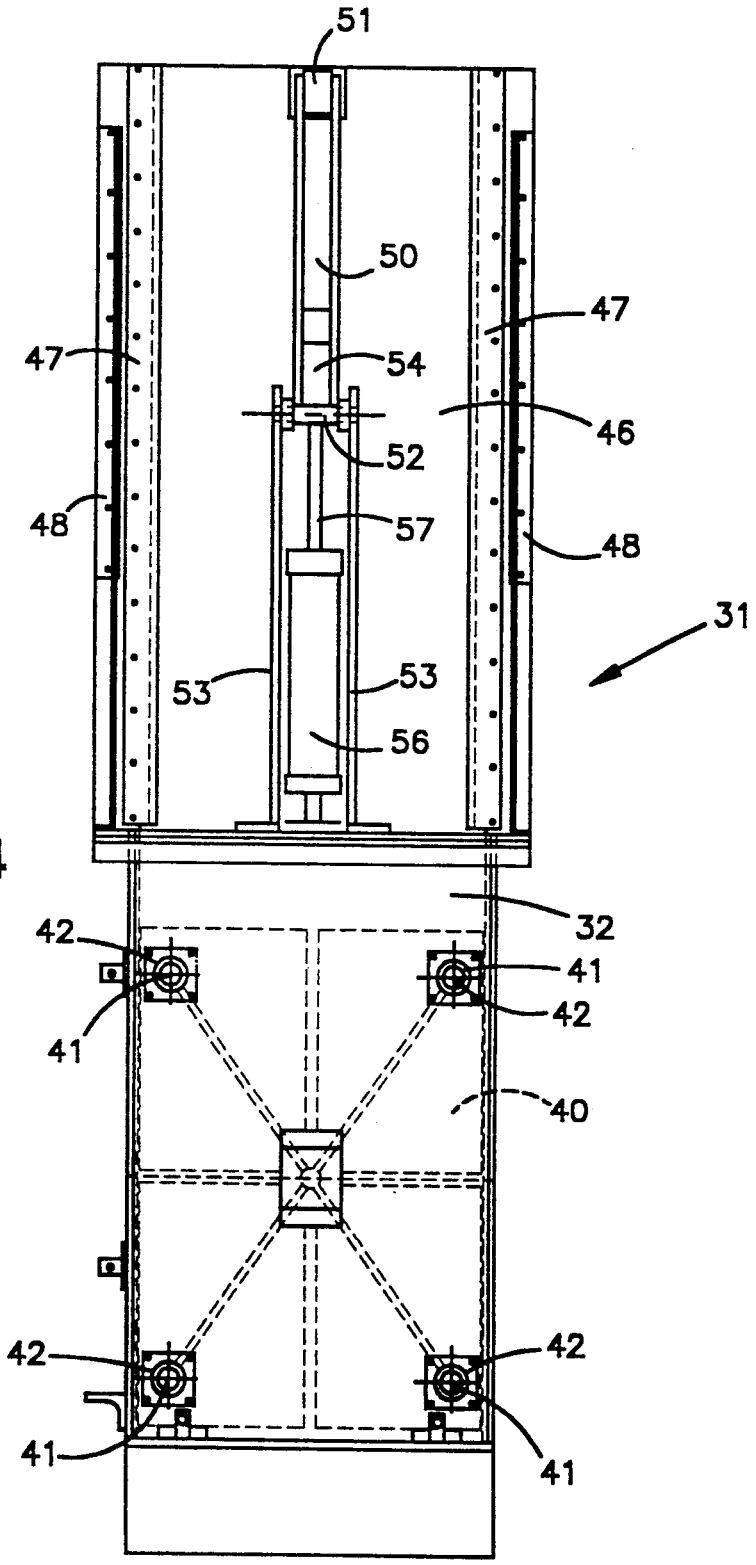
FIG. 4 is a end elevational view partially sectioned taken along line 4—4 of FIG. 3.

At the ejection end 33 the bottom of the enclosure 32 has an opening or slot which is aligned with the slot 28 in the upper side 12. The opening at the ejection end 33 of the enclosure 32 is similar in dimension to the slot 28 in that it permits a single end pad to pass therethrough but does not allow more than one end pad to pass through. The end pads are thus inserted one-by-one from the ejection end 33 of the enclosure 32 through the slot 28 into the downstream end of the baling chamber 15. 76 supply end 34 to the ejection end 33 by a pusher head 40 (FIG. 3) extending vertically at the supply end within the enclosure. To maintain the pusher head 40 in a vertical alignment, the pusher head is mounted on the end of four horizontally extending support rods 41. The support rods 41 extend outwardly from the supply end 34 of the enclosure and are maintained in a horizontal position by sleeves 42 mounted on the outside of the enclosure 32. As shown in FIG. 4, each of the support rods 41 is located near one of the corners of the pusher head 40. To provide powered movement of the pusher head 40, the pusher head is mounted on the end of a piston rod 43 which is connected to a pneumatic cylinder 44 extending from the supply end 34 of the enclosure 32.

The pressure provided by the pusher head 40 pushes the end pads against the end wall of the enclosure 32 at the ejection end 33, and this pressure normally prevents the end pad at the ejection end of the enclosure from falling through the slot 28. In addition, a gravity feed alone would not be a reliable means of feeding end pads through the slot 28. Therefore, additional means are provided to deliver the end pads through the slot 28 into the baling chamber 15 when the end pads reach the ejection end 33 of the enclosure 32.

This additional means includes a plate 46 which is retracted to a position located above the enclosure 32 as shown in FIGS. 3 and 4. The plate 46, which has approximately the same width and thickness as one of the end pads, is supported on each side above the enclosure 32 by vertically extending guides 47 mounted above the enclosure 32 at the ejection end 33. The guides 47 are supported by diagonally extending braces 48. The plate 46 is moved downwardly within the guides 47 into the ejection end 33 of the enclosure 32 by an actuating mechanism which includes a lever arm 50 pivotally attached at one end 51 to the top of the plate 46 and pivotally attached at the other end 52 to mounting flanges 53 extending upwardly from the supply end 34 of the enclosure 32. A pin extends between the mounting flanges 53, and the pin extends through an elongated slot 54 at the end 52 of the lever arm 50. The slot 54 is elongated to accommodate longitudinal movement of the lever arm 50 as the plate 46 moves up and down.

The lever arm 50 is moved by means of a hydraulic cylinder 56 which is pivotally mounted to extend vertically from the top of the enclosure 32. A piston rod 57 extends upwardly from the cylinder 56, and the piston rod is pivotally attached to the lever arm 50 at a location spaced from its attachment 52 to the mounting flange 53. As the cylinder 56 is actuated, the lever arm 50 moves about its pivotal mounting 52 on the flange 53, causing the plate 46 to move vertically within its guides 47. As the plate 46 moves downwardly into the enclosure 32, it moves immediately adjacent to the enclosure end wall at the ejection end 33 of the enclosure. The end pad that is positioned adjacent to the ejection end wall is thus pushed downwardly by the vertically moving plate 46, causing the end pad to be pushed through the slot 28 and into the baling chamber 15. The pusher head 40 assures that an end pad will be positioned against the end wall at the ejection end 33 of the enclosure 32, so that the plate 46 will always engage an end pad as it moves downwardly into the enclosure. The proper position of the end pad to be inserted can be further assured by providing a plurality of small holes on the end wall of the enclosure 32 at the ejection end 33, and connecting these holes to a suitable vacuum device, so that a vacuum is drawn through the holes and the end pad at the ejection end is pulled flat against the end wall. Such a vacuum arrangement also assures that the end pad is properly flat when it is pushed through the relatively thin slot 28.

Thus by means of the cylinders 44 and 56, end pads can be moved to the ejection end 33 of the enclosure 32 where they are individually pushed downwardly into the baling chamber 15 by the plate 46.

The operation of the baling apparatus of the present invention can now be described.

With tying wires placed across the end of the baling stream by the tying apparatus of U.S. Pat. No. 4,092,913, the baling head 16 is moved to an end pad insertion position in which the front of the baling head is located directly upstream from the position of the slot 28. The cylinder 56 is then actuated, and the plate 46 is raised to allow one of the end pads in the enclosure 32 to move against the end wall at the ejection end 33 of the enclosure. The cylinder 56 then reverses, causing the plate 46 to push one of the end pads in the enclosure 32 downwardly through the slot 28 into the baling stream. The end pad is held in place by the retainer dogs 29 in the baling chamber. The baling head 16 then returns to its fully retracted position.

The material to be baled is loaded into the baling chamber 15 through the hopper 19. If a weigh hopper is used, the material is fed into the weigh hopper with the baling head 16 in its fully retracted position until a selected weight is achieved, and the hopper door opens allowing the material to fall into the baler charging chamber. If a weigh hopper is used, a vertical prepack platen then activates to compress the material in the charging chamber into the baling chamber 15. If a conventional open hopper is used, the hopper 19 is filled with the baling head 16 in the retracted position, and a charge of material falls into the baling chamber 15.

When the desired charge of material is present in the baling chamber 15, the baling head 16 advances, compressing the material into the downstream end of the baling chamber 15 against the end pad and against the previously baled material in the throat portion 21. Resistance to the movement of the bales in the throat portion 21 is provided by the toggle-like mechanism 23 which acts to constrict the space between the floor 11 and the upper side 12. This resistance of the throat portion 21 to the movement of the bales through it allows the end of the last finished bale B to provide a firm wall against which the material in the baling chamber 15 is compacted by the baling head 16. This sequence repeats for the desired number of cycles, until the counter signals that the desired number of charges have been compressed or the desired weight has been achieved, or until the bale length measurement device 24 signals that the desired length of charges have been compressed, and the compressed material can now be turned into a finished bale.

The baling head 16 then advances to its fully advanced position or tying position which is a position downstream of the normal advanced baling stroke and beyond the end of the baling chamber 15. This pushes the compressed material into the throat portion 21 of the baling machine. The baling head 16 then retracts to the end pad insertion position upstream from the position of the slot 28. The cylinder 56 is then actuated to cause the plate 46 to move downwardly and push a second corrugated end pad downwardly through the slot 28 and into the baling stream behind the compressed material. The baling head 16 then returns to the fully advanced tying position carrying the end pad with it. A plurality of wires is then inserted automatically (by apparatus not shown in the drawings) through the openings 26 in the side 14 of the baling chamber 15 and through corresponding transverse openings in the baling head 16. After these wires have been tied, a finished bale of the compressed material has then formed between the two end pads. The wires may be automatically inserted and tied by the tying apparatus described in U.S. Pat. No. 4,092,913. The finished bale is forced through the throat portion 21 of the baling machine, in a manner such as that of the bales B and B'.

After the wires have been tied, the baling head 16 retracts to the end pad insertion position, and the cylinder 56 is actuated to eject another end pad from the enclosure 32 into the baling stream. The end pad is held in place by the retainer dogs 29 in the baling chamber. The baling head 16 then returns to its fully retracted position, and the cycle is repeated with material entering the baling chamber through the hopper and being compressed by the baling head against the end pad which was just inserted into the baling chamber. In accordance with this procedure, pads are provided on each end of each bale, and each bale is automatically tied by the tying apparatus.

A control panel may be placed at any convenient location on the baling machine 10. The control system for the apparatus can be arranged by persons skilled in the control systems art to provide for its automatic operation in connection with the operations of the baling machine and the tying apparatus. Such controls per se, involving essentially sequencing of the operative elements of the apparatus, comprise no part of this invention. Their desired functions are described for a full understanding of the apparatus.

It can be seen that one of the advantages of the end pad insertion mechanism 31 of the present invention is that the end pads are inserted into the baling chamber 15 vertically from the top rather than horizontally from the side. By inserting the end pads downwardly, the end pad insertion mechanism avoids interference with the automatic bale tying mechanism which ordinarily inserts tying horizontally from the sides of the baling chamber. The downward insertion of the end pads also allows for gravity to assist in dropping the end pads into the baling chamber.

Another advantage of the insertion mechanism 31 is that the enclosure 32 maintains the end pads in a vertical disposition so that they can be easily and quickly inserted into the baling chamber without reorientation or other unnecessary manipulation. The lever arm arrangement also provides a mechanism to move the plate 46 vertically while minimizing the overall height of the baling machine.

It will be obvious that various modifications can be made to the preferred embodiment just described. For example, while the enclosure 32 is shown with the supply end 34 to the right as shown in FIGS. 2 and 3, the enclosure can be mounted in the opposite direction with the end pads being moved with the enclosure in the same direction as the baling stream. However, such an arrangement does not provide for clearance for the support rods 41 or the cylinder 44 unless the feed hopper 19 is also repositioned.

While the invention has been shown and described with respect to a particular embodiment thereof, this is for the purpose of illustration rather than limitation, and other variations and modifications of the specific embodiment herein shown and described will be apparent to those skilled in the art, all within the intended spirit and scope of the invention. Accordingly, the patent is not to be limited in scope and effect to the specific embodiment herein shown and described nor in any other way that is inconsistent with the extent to which the progress in the art has been advanced by the invention.

What is claimed is:

1. A baling apparatus for baling material and for inserting end pads one at each end of each bale and for inserting tying wires around the baled material and around the end pads, comprising:

a longitudinally horizontally extending frame including a horizontal floor, a horizontal upper side extending generally parallel to the floor and thereabove, and fixed vertical enclosing sides extending perpendicularly from the floor to the upper side to form a baling chamber therewithin, the baling chamber having a forward end and a rearward end, a discharge chute being formed at the forward end of the baling chamber, the enclosing sides have openings for the insertion of the tying wires across the discharge chute, the upper side having a feed opening in the upper side at the baling chamber through which the material to be baled is delivered into the baling chamber, the upper side also having a slot, the slot being at a location which is rearward of the openings in the enclosing sides and which is forward of the feed opening; 170 a baling head longitudinally reciprocal within the baling chamber between a retracted position near the rearward end of the baling chamber and an advanced position near the forward end of the baling chamber;

means for reciprocating the baling head within the baling chamber between the retracted position and the advanced position;

means for inserting wires through the slots across the discharge chute; and means adjacent to the baling chamber for inserting an end pad downwardly through the slot into the baling chamber after the tying wires have been inserted across the discharge chute by the inserting means.

2. A baling apparatus as defined in claim 1, wherein the inserting means includes a vertically movable plate for pushing the pad through the slot.

3. A baling apparatus as defined in claim 2, wherein the inserting means includes means for moving the plate downwardly to push the pad through the slot.

4. A baling apparatus as defined in claim 3, wherein the inserting means includes means for moving the plate upwardly to a maximum height, and wherein the plate moving means includes a lever arm operatively connected to the plate and a fluid cylinder for moving the lever arm, the fluid cylinder being mounted below the maximum height of the plate.

5. A baling apparatus as defined in claim 1, wherein the inserting means includes an enclosure for holding a plurality of end pads in a vertical position.

6. A baling apparatus as defined in claim 5, wherein the inserting means includes means for moving end pads within the enclosure to a position adjacent to the slot.

7. A baling apparatus as defined in claim 6, wherein the inserting means includes means for holding one of the end pads flat against a portion of the enclosure to assist in inserting the end pads into the slot.

8. A baling apparatus as defined in claim 7, wherein the holding means includes means for drawing a partial vacuum against one side of the end pads.

9. A baling apparatus as defined in claim 5, wherein the enclosure includes means for holding a plurality of end pads that are essentially flat on each side.

10. A baling apparatus as defined in claim 1, wherein the advanced position of the baling head is forward of the location of the slot, and the baling head is movable to a position rearward of the location of the slot to permit an end pad to be inserted adjacent to the baling head.

11. A baling apparatus as defined in claim 1, wherein the baling head is positionable adjacent to the openings in the enclosing sides when the tying wires are inserted.

12. A baling apparatus as defined in claim 11, wherein the baling head has a plurality of transverse openings conforming to the openings enclosing sides through which the tying wires are inserted.

13. A baling apparatus for baling material and for inserting end pads one at each end of each bale and for inserting tying wires around the bale material and the end pads, comprising:

a longitudinally horizontally extending frame including a horizontal floor, a horizontal upper side extending generally parallel to the floor and thereabove, and fixed vertical enclosing sides extending perpendicularly from the floor to the upper side to form a baling chamber therewithin, the baling chamber having a forward end and rearward end, a discharge chute being formed at the forward end of the baling chamber, the enclosing sides having openings for the insertion of the tying wires across the discharge chute, the upper side having feed opening in the upper side at the baling chamber through which the material to be baled is delivered into the baling chamber, the upper side also having a slot through which an end pad may be inserted, the slot being at a location which is rearward of the openings in the enclosing sides and which is forward of the feed opening;

a baling head longitudinally reciprocal within the baling chamber between a retracted position near the rearward end of the baling chamber and an advanced position near the forward end of the baling chamber, the advanced position of the baling head being forward of the location of the slot, the baling head being movable to a position rearward of the location of the slot to permit an end pad to be inserted adjacent to the baling head;

means for reciprocating the baling head within the baling chamber between the retracted position and the advanced position;

means for inserting wires through the slots across the discharge chute; and means adjacent to the baling chamber for inserting an end pad downwardly through the slot into the baling chamber after the tying wires have been inserted across the discharge chute by the inserting means, including an enclosure for holding a plurality of end pads in a vertical position, means for moving end pads within the enclosure to a position adjacent to the slot, a vertically movable plate for pushing the pad ajacent to the slot through the slot, and means for moving the plate downwardly to push the pad through the slot and for moving the plate upwardly to a maximum height, the plate moving means having a lever arm operatively connected to the plate and a fluid cylinder for moving the lever arm, the fluid cylinder being mounted below the maximum height of the plate.

* * * * *

UNITED STATES PATENT AND TRADEMARK OFFICE

CERTIFICATE OF CORRECTION

PATENT NO. : 5,133,251

DATED : July 28, 1992

INVENTOR(S) : Jerold W. Johnson, et al.

It is certified that error appears in the above-identified patent and that said Letters Patent is hereby corrected as shown below:

Column 2, line 19, "event" should be --even--.

Column 5, line 12, delete "76" and substitute therefore --The end pads inside the enclosure 32 are moved from the--. This line should start new paragraph.

Column 7, line 55, after "tying" please insert --wires--.

Column 8, line 47, delete "170".

Signed and Sealed this

Twelfth Day of October, 1993

*Attest:*

*Attesting Officer*

BRUCE LEHMAN

*Commissioner of Patents and Trademarks*